United States Patent [19]

Center

[11] Patent Number: 4,615,133

[45] Date of Patent: Oct. 7, 1986

[54] FIRING PIN SELECTOR FOR GUN

[75] Inventor: Warren A. Center, Alton Bay, N.H.

[73] Assignee: K. W. Thompson Tool Company, Inc., Rochester, N.H.

[21] Appl. No.: 653,686

[22] Filed: Sep. 21, 1984

[51] Int. Cl.[4] ..... F41C 11/02

[52] U.S. Cl. ..... 42/69.01; 42/70.08

[58] Field of Search ..... 42/69 R, 69 A, 69 B, 42/70 F

[56] References Cited

U.S. PATENT DOCUMENTS

| | | | |
|---|---|---|---|
| 2,084,363 | 6/1937 | White | 42/69 R |
| 2,976,638 | 3/1961 | Owens | 42/69 X |
| 3,050,894 | 8/1962 | Ivy | 42/69 |
| 3,561,149 | 2/1971 | Center | 42/69 X |
| 3,601,918 | 8/1971 | Keppeler et al. | 42/70 F |
| 4,141,166 | 2/1979 | Schultz | 42/70 X |
| 4,395,839 | 8/1983 | Eder | 42/70 |

*Primary Examiner*—Peter A. Nelson

*Attorney, Agent, or Firm*—Blodgett & Blodgett

[57] ABSTRACT

A gun for firing center-fire and rim-fire cartridges, having a center-fire pin and a rim-fire pin mounted for axial sliding motion within a receiver, a hammer, and a firing selector mounted on the hammer for selectively engaging the rim-fire pin and the center-fire pin upon movement of the hammer toward the firing pins upon actuation of a trigger mechanism.

8 Claims, 9 Drawing Figures

FIRING PIN SELECTOR FOR GUN

BACKGROUND OF THE INVENTION

The present invention relates generally to a gun which is selectively adaptable for firing rim-fire and center-fire cartridges. The present invention relates more specifically to selector means for enabling the gun to be in either the rim-fire mode or the center-fire mode. The type of gun to which the present invention is directed includes two firing pins, one for center-fire and one for rim-fire as shown, for example, in my U.S. Pat. No. 3,561,149, issued Feb. 9, 1971. The gun also has interchangeable barrels for the different types of cartridges which are used in the gun. The two firing pins are located one above the other in a bushing within the receiver of the gun. A rotatably adjustable hammer nose is located between the firing pins and the hammer. The hammer nose can be adjusted so that it will either strike the top firing pin or the lower one. When the hammer is released by the trigger mechanism. The firing mode of the hammer nose is changed by pulling the hammer back to the cocked position and rotating the hammer nose with a screwdriver.

One of the major disadvantages of the adjustable rim-fire/center-fire type of gun such as that shown in my above-identified U.S. patent, is that a screwdriver must always be available to the shooter in order to be able to convert the gun from one firing mode to another. Another disadvantage of this type of gun is that there is no clear indication as to what firing mode the gun is in. Each time the gun is used, the shooter must check carefully the position of the hammer nose. These and other difficulties experienced with the prior art center-fire/rim-fire guns have been obviated by the present invention.

It is, therefore, a principle object of the invention to provide a hand-operated selector for a gun which is capable of selectively firing rim-fire and center-fire cartridges and which does not require the use of tools in order to change the firing mode of the gun.

Another object of this invention is the provision of a selector for a rim-fire/center-fire gun which is positioned on the outside of the gun at an easily accessible location.

A further object of the present invention is the provision of a selector for a rim-fire/center-fire gun which has means for indicating which fire mode that the gun is in.

It is another object of the present invention to provide a selector for a rim-fire/center-fire gun which has a neutral mode in which the gun is incapable of firing a rim-fire cartridge or a center-fire cartridge.

A still further object of the invention is the provision of a selector for a rim-fire/center-fire gun which is simple in construction and easy to use.

With these and other objects in view, as will be apparent to those skilled in the art, the invention resides in the combination of parts set forth in the specification and covered by the claims appended hereto.

SUMMARY OF THE INVENTION

In general, the invention consists of a gun for selectively firing rim-fire and center-fire cartridges, comprising a rim-fire pin and a center-fire pin mounted in a receiver and a hammer pin assembly mounted on the hammer for selectively engaging the rim-fire pin and the center-fire pin. More specifically, the gun comprises a hammer pin assembly having a center-fire hammer pin and a rim-fire hammer pin mounted on a hammer pin housing which is mounted on the hammer for movement between a rim-fire position and a center-fire position.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
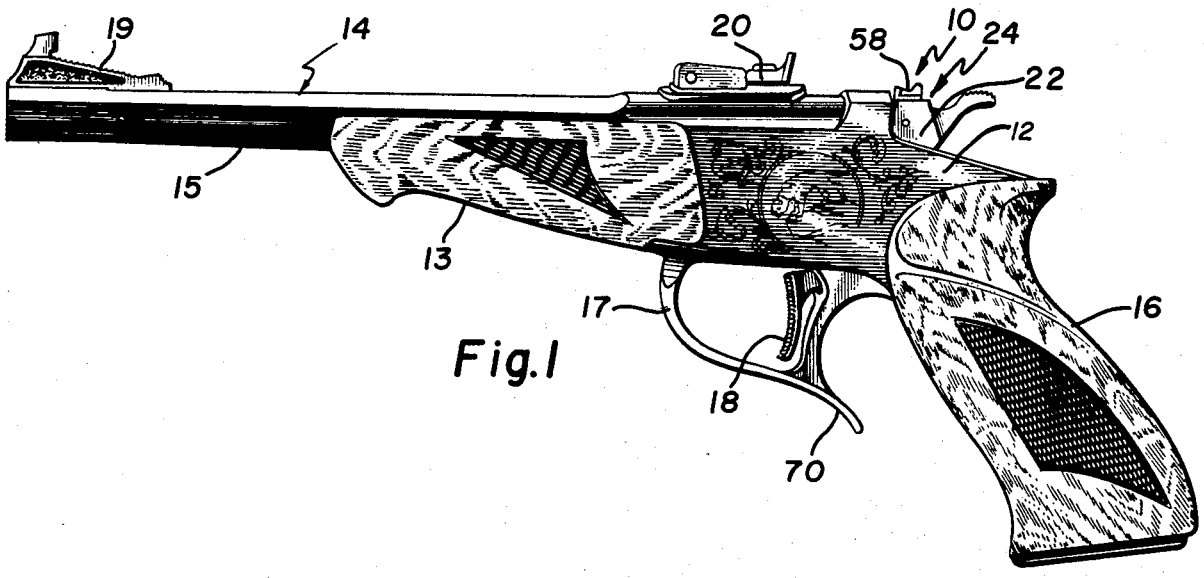
FIG. 1 is a side elevational view of a gun embodying the principles of the present invention.

Referring first to FIGS. 1–4 which show the general features of the invention, the gun is generally indicated by the reference numeral 10 and comprises a receiver 12 to which is attached a barrel assembly, generally indicated by the reference numeral 14. A handle or grip 16 is attached to the back end of the receiver. A trigger 18 is located forwardly of the handle and resides within a trigger guard 17. A forend 13 underlies the barrel assembly. The barrel is provided with a front sight 19 at its outer end and a rear sight 20 at its inner end. A hammer 22 is hingedly located in a recess in the upper right hand portion of the receiver. A firing pin selector, generally indicated by the reference numeral 24, is mounted on the hammer 22.

Figure 9:
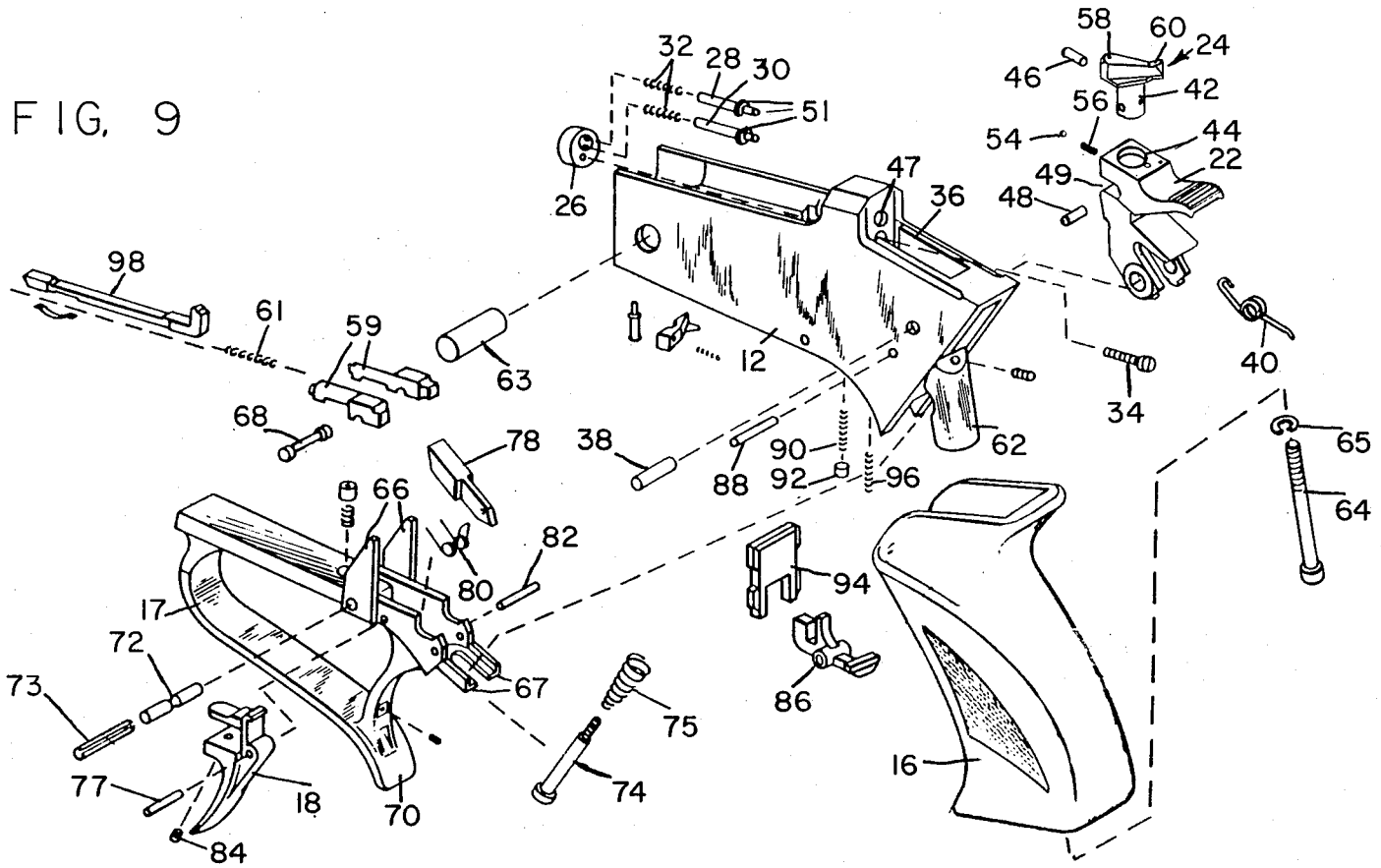
FIG. 9 is an exploded view showing the components of the receiver and trigger portions of the gun.

Referring particularly to FIG. 9, a cylindrical firing pin bushing 26 is located within a suitable bore in the receiver 12 and carries two firing pins 28 and 30. The pin 28 is a rim-fire pin and the pin 30 is a center-fire pin. The pins 28 and 30 are provided with suitable springs 32 which bias the pins toward the rear portion of the gun. The hammer 22 is located in a recess 36 of the receiver 12 and is pivotally mounted within the recess by means of a pivot pin 38. A wire spring 40 biases the hammer 22 toward a forward position.

Figure 5:
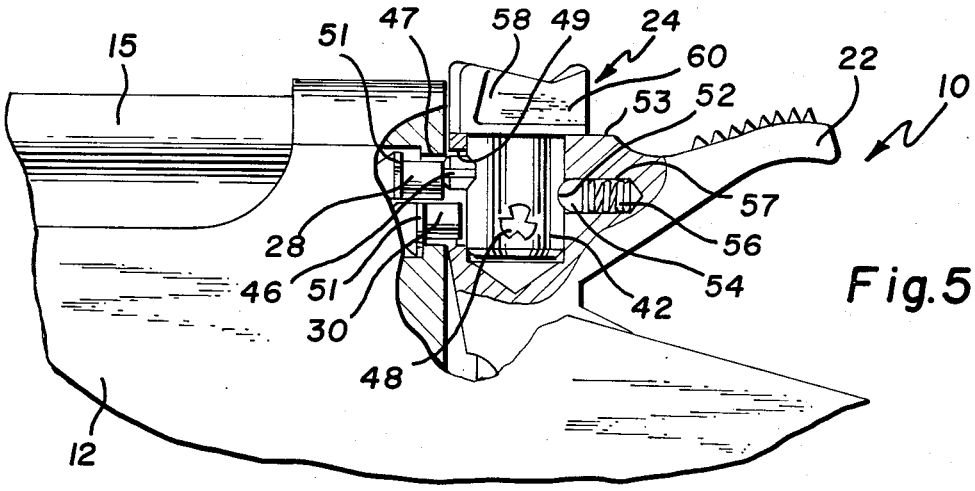
FIG. 5 is a fragmentary elevational view of the hammer and receiver portions of the gun, with portions broken away, and showing the firing pin selector in the first firing position.
Figure 6:
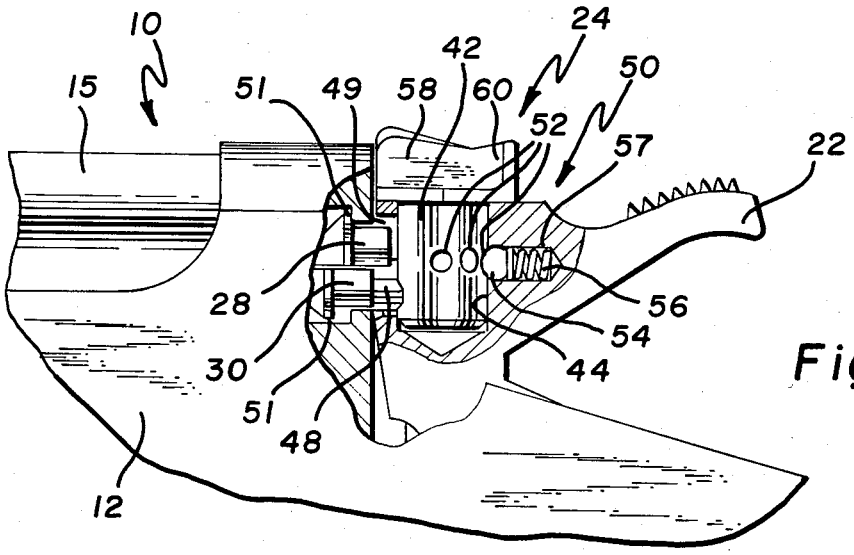
FIG. 6 is a view similar to FIG. 5, showing the firing pin selector in the second firing position.
Figure 7:
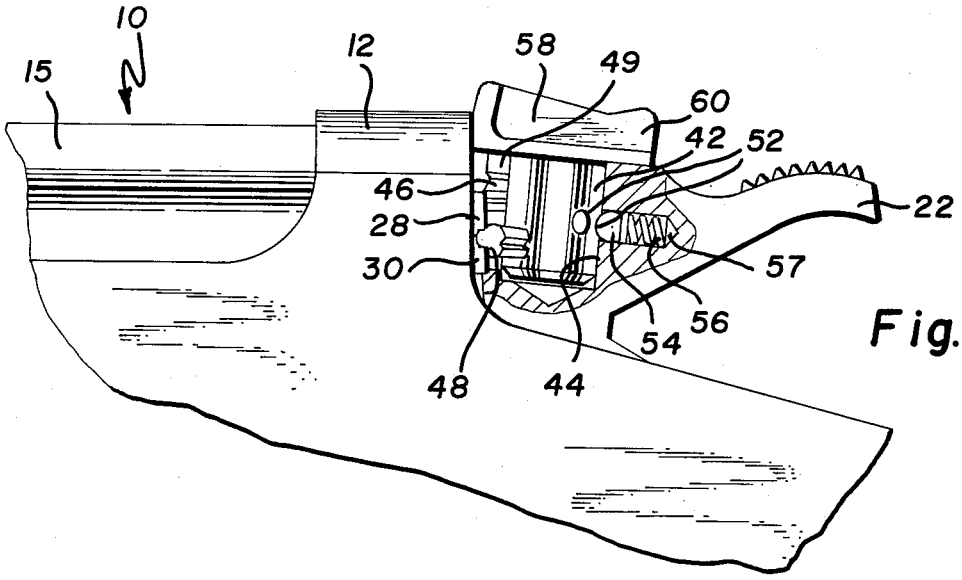
FIG. 7 is a view similar to FIG. 5, showing the firing pin selector in the neutral position.
Figure 8:
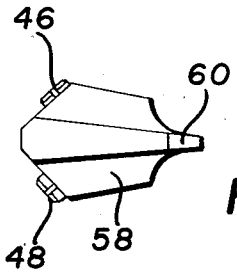
FIG. 8 is a plan view of the firing pin selector.

Referring also to FIGS. 5–7, the firing pin selector 24 includes a cylindrical hammer pin housing 42 which contains a rim-fire hammer pin 46 and a center-fire hammer pin 48. As shown more clearly in FIG. 5, the rim-fire hammer pin 46 is located above the center-fire hammer pin 48. However, the pins 46 and 48 are 90° out of vertical alignment about the central longitudinal axis of the housing 42 as shown in FIG. 8. The housing 42 is rotatably mounted within a cylindrical bore 44 in the upper portion of the hammer 22. The hammer 22 is provided with a forward slot 49 which intersects the bore 44, so that the hammer pins 46 and 48 extend into the slot 49, as shown in FIGS. 5–7. The forward ends of the firing pins 28 and 30 extend through a pair of apertures 47 in the receiver 12. The apertures 47 are aligned with the slot 49, so that under the bias of the springs 32, the forward ends of the firing pins 28 and 30 extend into the slot 49. Each of the pins 28 and 30 is provided with a shoulder 51 which limits the extent that the firing pins 28 and 30 can extend into the slot 49, as shown in FIGS. 5–7.

Figure 2:
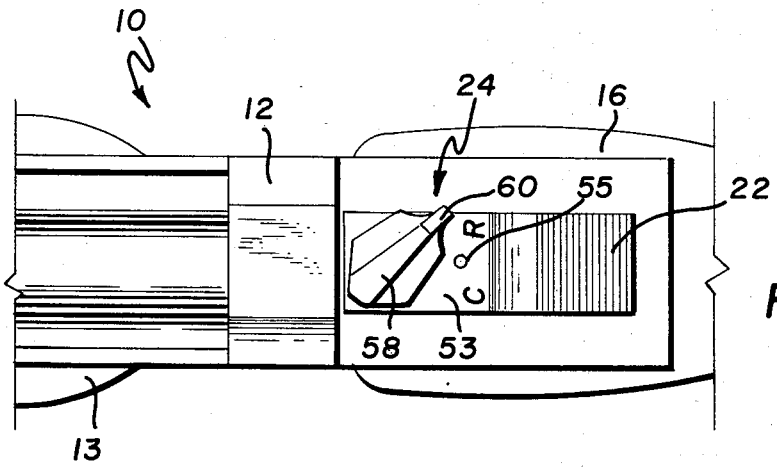
FIG. 2 is a fragmentary enlarged plan view of the gun showing the firing pin selector in a first firing position.
Figure 3:
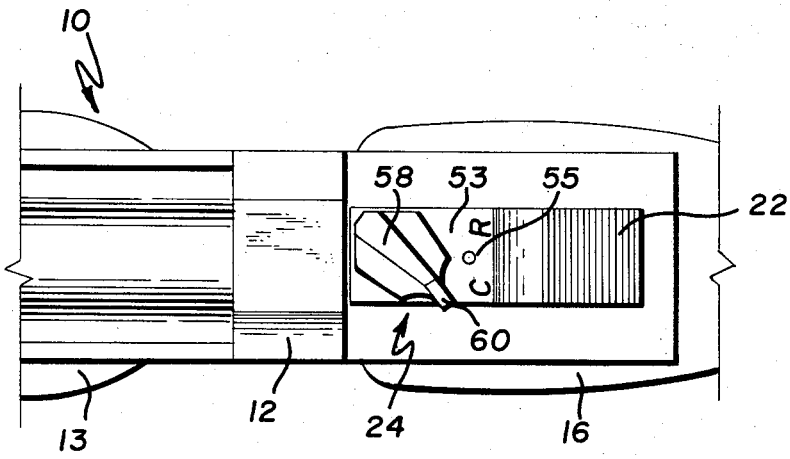
FIG. 3 is a view similar to FIG. 2, showing the firing pin selector in a second firing position.
Figure 4:
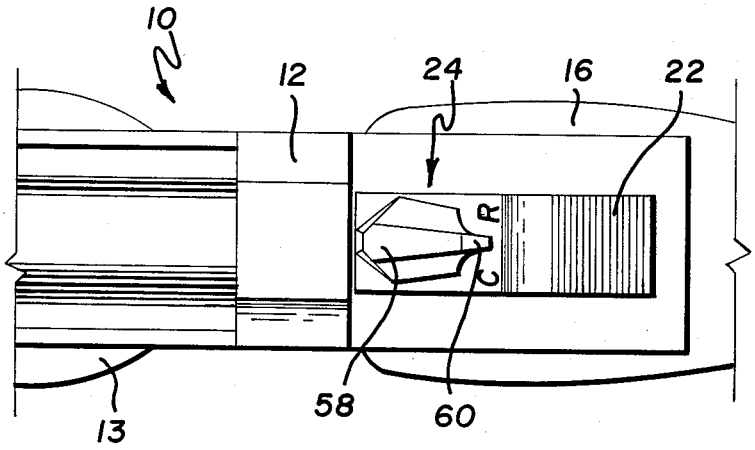
FIG. 4 is a view similar to FIG. 2, showing the firing pin selector in a neutral position.

Referring more particularly to FIGS. 2–4, the top of the housing 42 is provided with a finger grip 58 which extends above the hammer 22 in a position which is readily acceptable to the user's fingers. An indicator finger 60 extends rearwardly from the finger grip 58, so that it overlies the upper flat surface 53 of the hammer 22. The surface 53 is provided with indicia which corresponds to the several positions of the firing pin selector. This indicia includes a dot which is located between the letters C and R. When it is desired to set the gun in the rim-fire mode, the firing pin selector 24 is rotated within the bore 44, so that the indicator finger 60 is adjacent the letter R as shown in FIG. 2. In this position, the rim-fire hammer pin 46 is axially aligned with the rim-fire pin 28, as shown in FIG. 5. When it is desired to set the gun in the center fire mode, the firing pin selector 24 is rotated so that the indicator finger 60 is adjacent the letter C as shown in FIG. 3. In this position, the center-fire hammer pin 48 is aligned with the center-fire pin 30, as shown in FIG. 6. The gun is set in a neutral mode by rotating the firing pin selector 24 to the position shown in FIG. 4 so that the indicator finger 60 is between the letters C and R and covers the dot which is located between the letters C and R. When the firing pin selector 24 is in this position, the hammer pins 46 and 48 are out of alignment with their respective firing pins 28 and 30, as shown in FIG. 7. This represents the neutral or safety position, wherein the gun is incapable of center-fire or rim-fire. The firing pin selector 24 is maintained in one of the three positions by detent means generally indicated by the reference numeral 50. Detent means 50 comprises three recesses 52 in the hammer pin housing 42 and a ball 54 which is located in a bore 57 in the hammer 22. The ball 54 is urged toward the hammer pin housing 42 by a spring 56 and seats into one of the recesses 52 when the firing pin selector 24 is in any one of its three modes.

Referring particularly to FIG. 9, a bolt 59 is adapted to slide in a suitable transfer slot in the barrel assembly and is provided with a spring 61 which biases it toward engagement with a lip, not shown, on the receiver. A roller 68 lies in a suitable groove on the underside of the bolt 59 to withdraw the bolt from engagement with the receiver to prevent opening of the breech; that is to say, swinging of the barrel assembly 14 about a pivot pin 63 as a hinge point in the forward end of the receiver.

The rear end of the receiver 12 is provided with a threaded peg 62 to which the grip 16 is attached. The grip is locked in place by the use of a long bolt 64 and its washer 65. The trigger guard 17 is held in the receiver 12 and is provided in its upper portion with two ears 66 which are adapted to engage the enlarged ends of the roller 68. The trigger guard is provided with a horn 70 which extends backwardly toward the grip 16, in position to be engaged by the shooter's finger. The trigger guard is pivotally held in place within the receiver by a guard pin 72 and a pin clip 73. The rearward end of the trigger guard 17 is forked at 67 and slidable on a guard stop screw 74 and biased downwardly by a spring 75. The trigger 18 is pivotally attached to the trigger guard by means of a trigger pin 77 and engages a striker 78 which is pivotally attached to the trigger guard by means of a striker spring 80 and a striker pin 82. The striker spring 80 also biases the striker 78 upwardly. The trigger 18 is biased forwardly by means of a spring 84. A seer 86 is pivotally mounted in the receiver 10 by means of a pivot pin 88. A seer spring 90, assisted by a plunger 92, maintains the seer in a biased condition. A safety 94 is slidedly mounted in the receiver 12 and is biased upwardly by a safety spring 96. An extractor 98 is slidedly mounted within a slot, not shown, under the cartridge chamber of the barrel. All of the elements relating to the trigger mechanism and their function in operating the hammer 22 are well known and explained more fully in my earlier patent which is identified in the Background of the Invention.

The operation and advantages of the present invention will now be readily understood in view of the above description. The gun 10 is designed for the use of interchangeable barrels which are chambered for a variety of factory and custom loaded cartridges. Some of the cartridges require rim-fire and other cartridges require center-fire. When it is desired to fire a rim-fire cartridge, the appropriate barrel is applied to the receiver 12 as set forth, for example in my prior U.S. Pat. No. 3,561,149. The shooter then grasps the finger grip 58 and rotates the firing pin selector 24 to the rim-fire position, wherein the indicator finger 60 is adjacent the letter R, as shown in FIG. 2. This sets the gun in the rim-fire mode, wherein the rim-fire hammer pin 46 is axially aligned with the rim-fire pin 28, as shown in FIG. 5. When the hammer 22 is cocked, the rearward end of the firing pin 28 is biased to the slot 49 by its spring 32. When the hammer is released by the trigger mechanism, the hammer pin 46 strikes the rim-fire pin 28 which, in turn, strikes the rim-fire cartridge in the breech to discharge the same. When the shooter wishes to fire a center-fire cartridge, the gun is equipped with the appropriate barrel which corresponds with the caliber of the center-fire cartridge being used. The shooter then grasps the finger grip 58 and rotates the fire pin selector so that the indicator finger 60 is adjacent the letter C on the surface 53 of the hammer, as shown in FIG. 3. This sets the firing pins selector in the center-fire mode, wherein the center-fire hammer pin 48 is axially aligned with the center firing pin 30, as shown in FIG. 6. When the hammer 22 is cocked, the rearward end of the center-fire pin 30 is biased into the opening 49 by its spring 32. When the hammer 22 is released by the trigger mechanism, the hammer pin 48 strikes the end of the center-fire pin 30. This causes the firing pin to strike the center of the center-fire cartridge which is positioned in the breech of the gun. When the firing pin selector is in the rim-fire position shown in FIG. 2 or the center-fire shown in FIG. 3, the dot 55 is exposed, indicating that one of the firing pins is armed and that the pistol will discharge if the hammer falls with a cartridge or "round" in the chamber. The dot 55 is preferably colored or otherwise distinctive, so as to attract the shooter's attention that the gun is in a firing mode. When the firing pin selector is moved to the neutral or intermediate position shown in FIG. 4, the dot 55 is covered by the indicator finger 60 and neither of the hammer pins 46 or 48 is aligned with its respective firing pin, as shown in FIG. 7. This represents the safety position of the gun, wherein the gun will not discharge if the hammer falls with a "round" in the chamber.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Gun for selectively firing rim-fire and center-fire cartridges comprising:
   (a) a receiver,
   (b) a center-fire pin mounted in the receiver for axial sliding movement relative to the receiver,
   (c) a rim-fire pin mounted in the receiver for axial sliding movement relative to the receiver,
   (d) a trigger mechanism,
   (e) a hammer pivotally mounted on the receiver and operatively-connected to the trigger mechanism for movement between a firing position and a cocked position,
   (f) a pin selector housing mounted on the hammer for selective movement between a rim-fire position and a center-fire position,
   (g) a center-fire hammer pin mounted on said housing so that said center-fire hammer pin is in firing alignment with said center-fire pin when said housing is in said center-fire, and
   (h) a rim-fire hammer pin mounted on said housing so that said rim-fire hammer pin is in firing alignment with said rim-fire pin when sid housing is in said rim-fire position.

2. Gun for selectively firing rim-fire and center-fire cartridges comprising:
   (a) a receiver adapted to receive a barrel for a rim-fire cartridge or a barrel for a center-fire cartridge,
   (b) a center-fire pin mounted in the receiver for axial sliding movement relative to the receiver in firing alignment with the center of a center-fire cartridge which is positioned in the center-fire barrel,
   (c) a rim-fire pin mounted in the receiver for axial sliding movement relative to the receiver in firing alignment with the rim of a rim-fire cartridge which is positioned in the rim-fire barrel,
   (d) a trigger mechanism,
   (e) a hammer pivotally mounted on the receiver and operatively-connected to the trigger mechanism for movement between a firing position and a cocked position.
   (f) a firing pin selector housing mounted on the hammer for selective movement between a rim-fire position and a center-fire position,
   (g) a center-fire hammer pin mounted on said housing so that said center-fire hammer pin is in firing alignment with said center-fire position pin when said housing is in said center-fire, and
   (h) a rim-fire hammer pin mounted on said housing so that said rim-fire hammer pin is in firing alignment with said rim-fire pin when said housing is in said rim-fire position.

3. Gun as recited in claim 2, wherein a selector button is fixed to the hammer pin housing and exposed at the outer periphery of the gun for manipulation by the user's fingers to selectiely move said housing to either said center-fire position of said rim-fire position.

4. Gun as recited in claim 3, wherein the button includes an indicator finger and the hammer has an upper surface which is provided with indicia which corresponds with each firing mode of the gun and located so that when the firing pin selector is moved to any one of the firing mode positions, the indicator finger is positioned adjacent the indicia which corresponds with that firing mode position.

5. Gun as recited in claim 2, wherein detent means are provided for accurately positioning and yieldably holding the housing in either said center-fire position or said rim-fire position.

6. Gun as recited in claim 2, wherein said housing is movable to a neutral portion in which the hammer pins are not aligned with either of the firing pins.

7. Gun as recited in claim 2, wherein detent means are provided for accurately positioning and yieldably holding the housing in a selected one of said center-fire/rim-fire and neutral positions.

8. Gun as recited in claim 2, wherein one of said firing pins is located above the other of said firing pins, wherein said hammer pin housing is mounted for rotation about a vertical axis and wherein each of said hammer pins is located on the housing at the same level as its corresponding firing pin when the hammer is in said firing position.

* * * * *

UNITED STATES PATENT AND TRADEMARK OFFICE

CERTIFICATE OF CORRECTION

PATENT NO. : 4,615,133

DATED : October 7, 1986

INVENTOR(S) : Warren A. Center

It is certified that error appears in the above-identified patent and that said Letters Patent are hereby corrected as shown below:

Column 1, line 20, delete ".The" and substitute therefor ---, the ---. Column 4, line 47, change "pins" to --- pin ---. Claim 1, line 33, change "sid" to --- said ---. Claim 3, line 19, change "selectiely" to --- selectively ---.

Signed and Sealed this

Twenty-eighth Day of April, 1987

*Attest:*

DONALD J. QUIGG

*Attesting Officer*

*Commissioner of Patents and Trademarks*